US007240683B2

(12) United States Patent
Zutich

(10) Patent No.: US 7,240,683 B2
(45) Date of Patent: Jul. 10, 2007

(54) DISMOUNTABLE OUTDOOR SHELTER KIT

(76) Inventor: Stoyan Zutich, P.O. Box 43, Bracebridge, ON (CA) P1L 1T5

( * ) Notice: Subject to any disclaimer, the term of this patent is extended or adjusted under 35 U.S.C. 154(b) by 758 days.

(21) Appl. No.: 10/741,275

(22) Filed: Dec. 22, 2003

(65) Prior Publication Data

US 2005/0133076 A1 Jun. 23, 2005

(51) Int. Cl.
*E04H 15/00* (2006.01)

(52) U.S. Cl. ..... 135/87; 135/121; 135/124

(58) Field of Classification Search ..... 135/87, 135/96, 20.1, 121, 124; 108/50.12; 297/184.1, 297/184.15; D25/56, 57; 5/414
See application file for complete search history.

(56) References Cited

U.S. PATENT DOCUMENTS 2,353,220 A * 7/1944 Charlop ..... 5/128
2,970,600 A * 2/1961 Schultz ..... 135/140
3,006,705 A * 10/1961 Williams et al. ..... 108/14
4,643,479 A * 2/1987 Servi ..... 297/184.15
4,796,391 A * 1/1989 Lu ..... 52/73
5,185,792 A * 2/1993 Shimada ..... 360/60
D363,790 S * 10/1995 Boyd ..... D25/56
5,564,452 A * 10/1996 Kitchen ..... 135/96
D412,993 S * 8/1999 Chipman et al. ..... D25/56
6,155,280 A * 12/2000 Powell et al. ..... 135/124
6,581,616 B1 * 6/2003 Venegas, Jr. ..... 135/121
6,823,883 B1 * 11/2004 Sears ..... 135/128

FOREIGN PATENT DOCUMENTS

CA 2 452 791 * 10/2005
EP 0 286 556 A1 * 10/1988
EP 0 623 718 A1 * 11/1994

* cited by examiner

*Primary Examiner*—Robert Canfield
(74) *Attorney, Agent, or Firm*—J. Gordon Thomson

(57) ABSTRACT

A dismountable outdoor shelter kit for mounting upon an outdoor surface characterized by its anticlinal canopy that has an apex for shedding water and dirt and for providing protection from the sun. The shelter kit includes canopy supporting members and bracing members designed to give the shelter kit structural stability once assembled. Each of the main supporting members of the shelter kit is made up of a plurality of mated members, including, a bottom foot member adapted for transferring structural loads from the anticlinal canopy to the outdoor surface; a middle vertical member mated to the bottom foot members; and, an anticlinal cantilevered member adapted to support the anticlinal canopy. The canopy made from a rectangular sheet of material having suitable characteristics of fire resistance. The sheet has valences, depending flaps fixed to the bottom edges of the sheet and a sleeve structure adapted for receiving a bracing rod in order to fix the sheet to the canopy support structure.

19 Claims, 18 Drawing Sheets

DISMOUNTABLE OUTDOOR SHELTER KIT

CROSS-REFERENCE TO RELATED APPLICATIONS

Not applicable.

BACKGROUND

1. Field of the Invention

This invention relates to portable shelters and their framework, and more specifically, a dismountable outdoor shelter kit adapted for providing shelter from the elements for a barbeque on a patio.

2. Description of the Prior Art

Recreational home-based outdoor activities such as barbequing can often be interrupted due to inclement weather, most often rain. Often the barbequing operation has to be terminated until the inclement weather passes. Such delays lessen the enjoyment of outdoor cooking.

Inventors have created several types of outdoor shelters than may be adapted to barbeque operations in such a way as to protect the food exposed on the barbeque grill and the operator from rain or an excessively strong sun. For example, U.S. Pat. No. 5,185,972 entitled "Modular Canopy" issued to Markiewicz on Feb. 16, 1993, discloses an all purpose modular canopy system formed by a plurality of interconnecting sections. The invention requires a substantial number of individual components and therefore it is complex, difficult and expensive to manufacture and difficult to assemble. Hence, this invention is not suitable for back yard use and is not suitable as a kit that can be inexpensively purchased. Generally, previously known outdoor shelters share the same disadvantages:

a. their manufacture requires the fabricating of an extensive number of supporting elements;
b. they are not easily and quickly mounted and dismounted without special skills;
c. they are generally unattractive;
d. rain and dirt can accumulate on the top of the shelter; and,
e. they do not provide a suitable area of shelter for barbeque operations to take place.

SUMMARY OF THE INVENTION

In accordance with the present invention, there is provided a dismountable outdoor shelter kit comprising an anticlinal canopy having an apex for shedding water and dirt and providing shelter from the sun. The anticlinal canopy is sufficiently dimensioned to provide for an adequate outdoor sheltered area for barbequing operations. There is also included a canopy structure comprising a first canopy supporting member and a second canopy supporting member that is identical to the first canopy supporting member. To stabilize the first and second canopy supporting members there is include for each of them a stabilizing rod fixed between the surface upon which the shelter is mounted and each of the first and second canopy supporting members. To support the canopy and to maintain overall stability of the structure, there is included a plurality of bracing rods. The bracing rods are fixed to the canopy supporting members by fixing means. Fixing means is generally a combination of bolt, nut and lock washers made from a suitable corrosion resistant material such as stainless steel.

The canopy supporting members are identical and can be made from a single tube. However, in the preferred embodiment of my invention each of the canopy supporting members are made up of sections, namely, a bottom foot member adapted for transferring structural loads from the canopy to the surface upon which the shelter is mounted; a middle vertical member mated to the bottom foot member; and, an anticlinal cantilevered member adapted to support the anticlinal canopy and mated to the middle vertical member.

Structural stability is provided to the shelter kit by a plurality of bracing rods. These include a first, second and third parallel lateral bracing rods fixed between first and second canopy supporting members, a fourth and fifth bracing rods fixed between the canopy supporting members and the first lateral bracing rod, and a first and a second moment resisting rods placed to support the anticlinal cantilevered members.

The canopy comprises a sheltering rectangular sheet having valences depending from each of the sides of the rectangular sheltering surface. The valances are used to ensure that any water run-off drops straight off of the canopy and does not curl under the canopy and drop within the sheltered area. The canopy is fixed the frame structure by a plurality of depending flaps that are fixed to the bottom edges of the sheltering rectangular sheet. Each of the flaps accepts a parade of equally spaced grommets. The canopy also includes a sleeve structure for receiving the third lateral bracing rod in order to fix the sheltering rectangular sheet to the canopy support structure. The sheltering rectangular sheet is manufactured from a material having selected characteristics of flexibility, water impermeability, fire resistance, mould resistance and UV resistance. Such fabrics include PVC vinyl, sail cloth, parachute cloth, nylon, polyethylene; marine canvass, and marine tonneau. Rope is used to tie the canopy to the structural frame by way of the flaps and grommets.

OBJECTS AND ADVANTAGES OF THE INVENTION

My invention has the following advantages and objectives:

a. to provide a portable shelter kit that does not require the fabrication of an extensive number of supporting elements;
b. to provide a portable shelter kit that is easily and quickly mounted and dismounted without special skills;
c. to provide a shelter kit that is aesthetically pleasing;
f. to provide a shelter kit that sheds rain and dirt and provides shelter from the sun; and,
g. to provide a shelter kit that provides a suitable area of shelter under which barbeque operations can take place.

Further objects and advantages will become apparent from a consideration of the ensuing description and drawings.

DETAILED DESCRIPTION

My invention is a dismountable outdoor shelter kit for use over barbeques. The shelter is advantageously sold in kit form and is easily mounted and dismounted by individuals without any special skill or special tools. The kit has been designed to reduce the number of supporting members while at the same time resulting, once assembled, in a strong and stable shelter capable of withstanding a variety of weather conditions.

Figure 1:
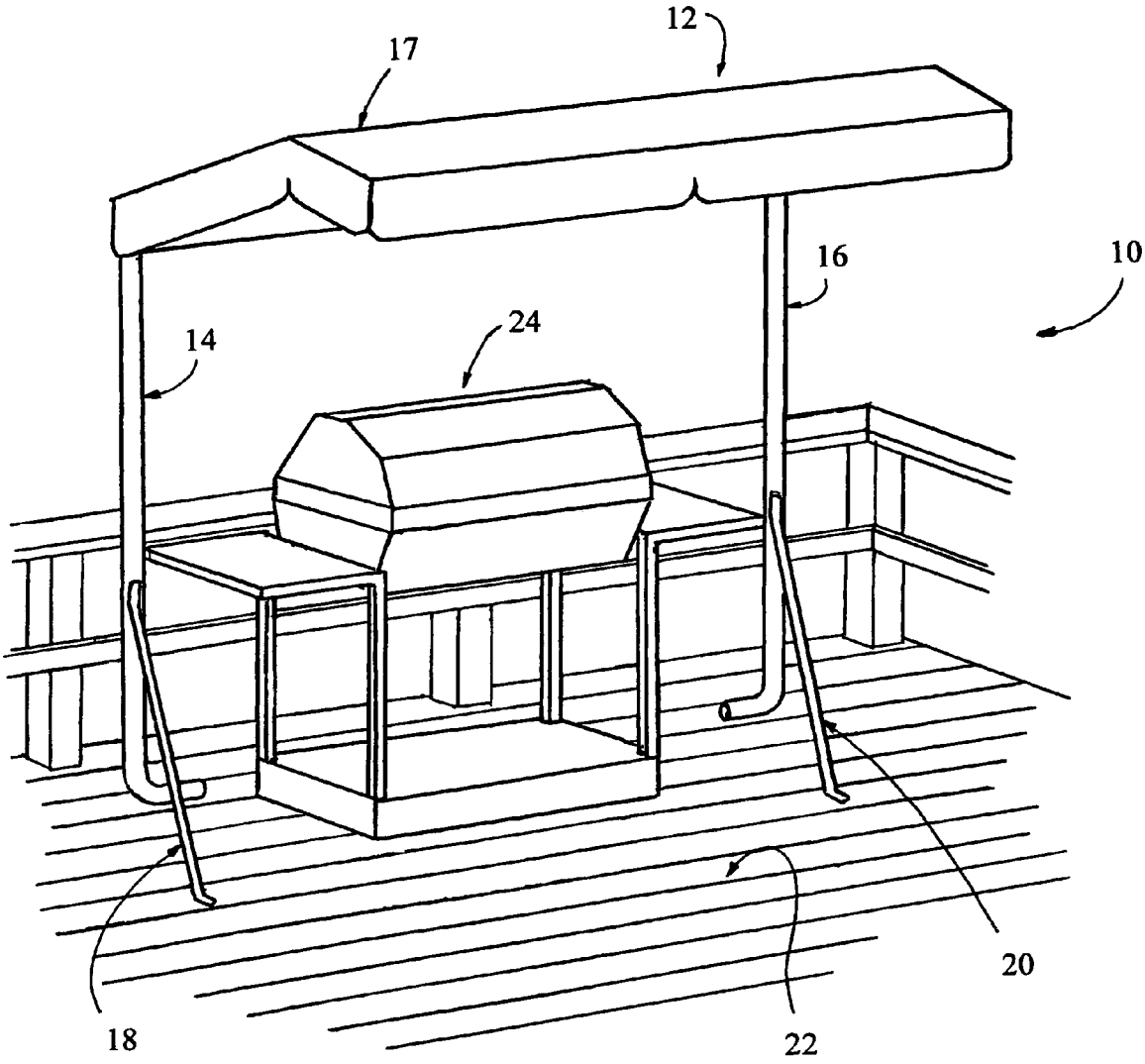
FIG. 1 is a front perspective view of the assembled and mounted shelter kit over a barbeque on a patio surface.

Referring to FIG. 1, there is shown the kit form of my invention assembled showing the relationship between its component parts. The invention, shown generally as (10), comprises an anticlinal canopy (12), a first canopy supporting member (14) and a second canopy supporting member (16). Each of the first and second canopy supporting members will not stand on their own and therefore there is further included in my shelter kit a first canopy supporting member stabilizing rod (18) and a second canopy supporting member stabilizing rod (20). As shown in FIG. 1, my shelter kit may be assembled and mounted onto a hard patio surface (22) or on a soft grass surface. The shelter canopy (12) is sufficiently dimensioned to provide an adequate sheltered area to cover a barbeque (24).

In one embodiment of the invention, the first (14) and second (16) canopy supporting members are shown in FIG. 1 as having a tubular single piece construction. However, in another preferred embodiment of the invention the first and second canopy supporting members are assembled from a plurality of mated parts as illustrated in other diagrams in this specification.

The tubing used is preferably steel tubing that has an aluminized protective coating. This is the same type of tubing used to fabricate exhaust systems for automobiles. The steel has a low carbon content which permits it to bend as necessary. Generally, the outside diameter of the tubing is 2.25 inches and the wall thickness is 0.049 inches for the first and second canopy supporting members. The smaller bracing rods have an outside diameter of 1.25 inches and a wall thickness of 0.058 inches. A thinner wall thickness of 0.049 inches for the smaller bracing rods may also be used where such material is available. The gauge or thickness of the tubing must be adequate to provide strength to the over all structure while retaining its light weight for easy assembly and mounting.

The anticlinal apex (17) of the canopy is about 80 inches from the surface (22) to which the shelter kit is mounted. The width of the shelter is about 78 inches and the canopy projects about 60 inches from back to front.

Figure 2:
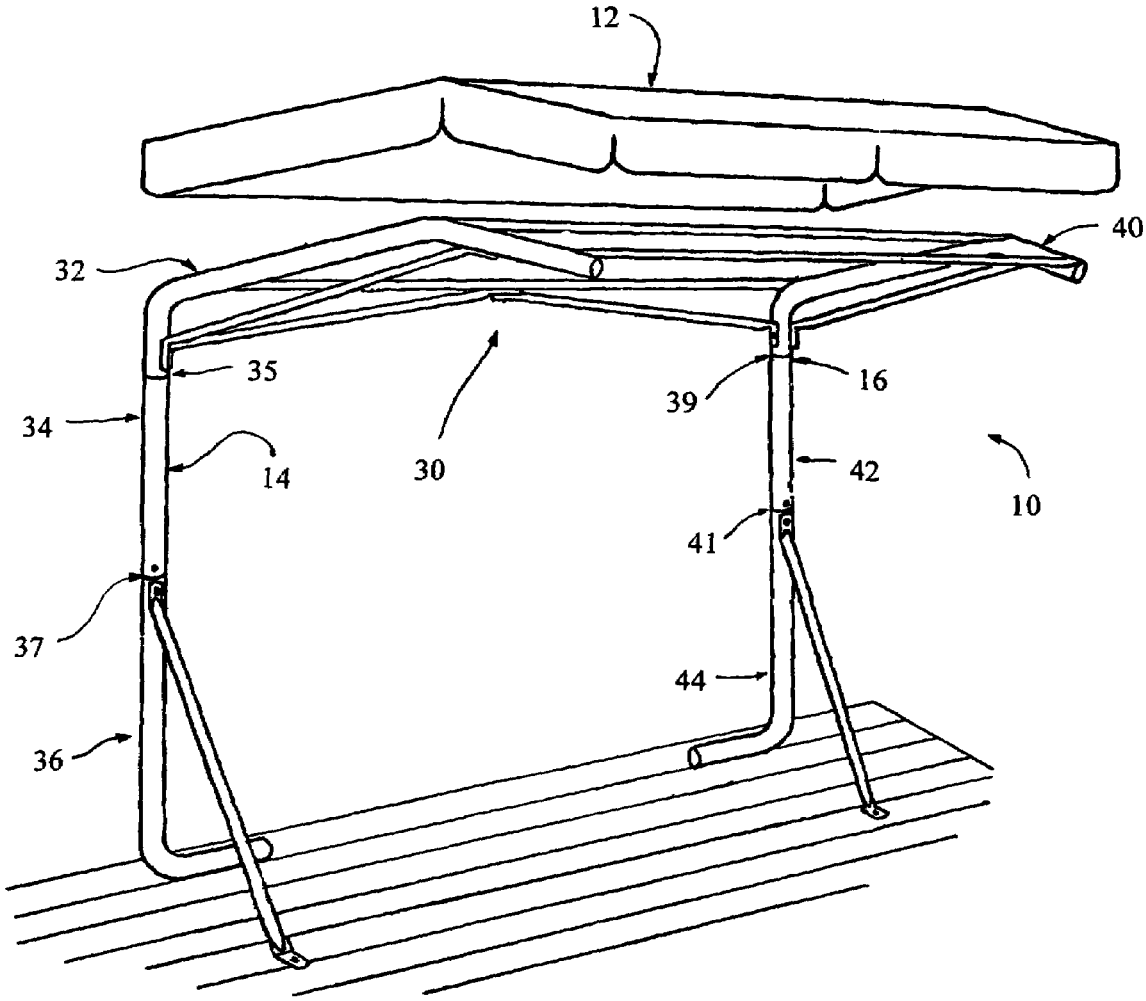
FIG. 2 is a front perspective view of the assembled and mounted shelter kit with the canopy raised for viewing the detail of the canopy supporting structure.

Referring now to FIG. 2, there are shown additional details of my shelter kit (10). In this drawing the canopy (12) is raised from the canopy support structure showing a plurality of bracing rods, generally numbered as (30) and as well to show anticlinal shape of members (32) and (40).

The first canopy support member (14) comprises three members. There is an anticlinal cantilevered member (32) adapted for supporting the anticlinal canopy; a middle vertical member (34) mated to the anticlinal cantilevered member; and, a bottom foot member (36) mated to the middle vertical member. In another embodiment of the invention, the bottom foot member and the middle vertical member are made as a single member. The second canopy support member (16) is identically configured having an anticlinal cantilevered member (40), a middle vertical member (42) mated with the anticlinal cantilevered member (40) and a bottom foot member (44) mated to the middle vertical member (42). In another embodiment of the invention, the middle vertical member and the bottom foot member are made as a single member. Note in FIG. 2, that the two bottom foot members (36) and (44) are inward facing to reduce the tripping hazard associated with such projecting members. In this embodiment the members are connected to each other using a type of slip sleeve and collar joint that provides a good frictional fit between the joined members. As well, as more fully described herein, each of the members are fixed to each other using fixing means that comprise a bolt, nut and washer combination. Typically these items are manufactured from stainless steel or some other corrosion resistant material. The joints between the mated members are shown at (35), (37), (39) and (41). Depending on how the tubes are fabricated the location of these joints on the tubes may vary. Alternatively, the canopy support members may be single pieces of tubing bent into the desired shape. There are a variety of bending machines available to bend the tubing and, generally, machines of the type used to bend automobile exhaust pipe will work for my invention.

FIG. (3) illustrates the bottom foot member (36) of the first canopy supporting member (14). It has an "L" shape. There is shown a first vertical section (50) having a compressed top end portion (51) and a first end (52) and a second end (54). The tube has a diameter (58) that is consistent along its length. The compressed top end portion (51) has a diameter (56) and is adapted to fit inside of the bottom end (92) of the middle vertical member (34) as illustrated on following figures. Bend (60) transitions from the vertical section (50) by way of a ninety degree directional change to horizontal section (62) extending away from the bend a distance suitable to act as a load bearing member for the canopy and transfer the weight of the canopy to the load bearing surface (22). The open second end (54) of the bottom foot member (36) includes cap (64) to cover any sharp edges and to prevent moisture from entering the tube and promoting corrosion. An aperture (59) is shown which extends through the tube vertical member (50). and is adapted to accept fixing means for fixing the top end of the first canopy supporting member stabilizing rod (18). An aperture (61) is included and is adapted to accept fixing means for fixing the bottom member (36) to the middle member (34). Additional apertures (65) and (67) are included and are adapted to receive anchor means for anchoring the canopy support member to the surface upon which the shelter kit is assembled. The surface may be wood, concrete, stone or grass and a person skilled in the art would understand that the anchor means would be, correspondingly, wood screws, concrete screws, or stakes of adequate length to act as suitable anchors. These anchors are included in the kit.

Figure 4:
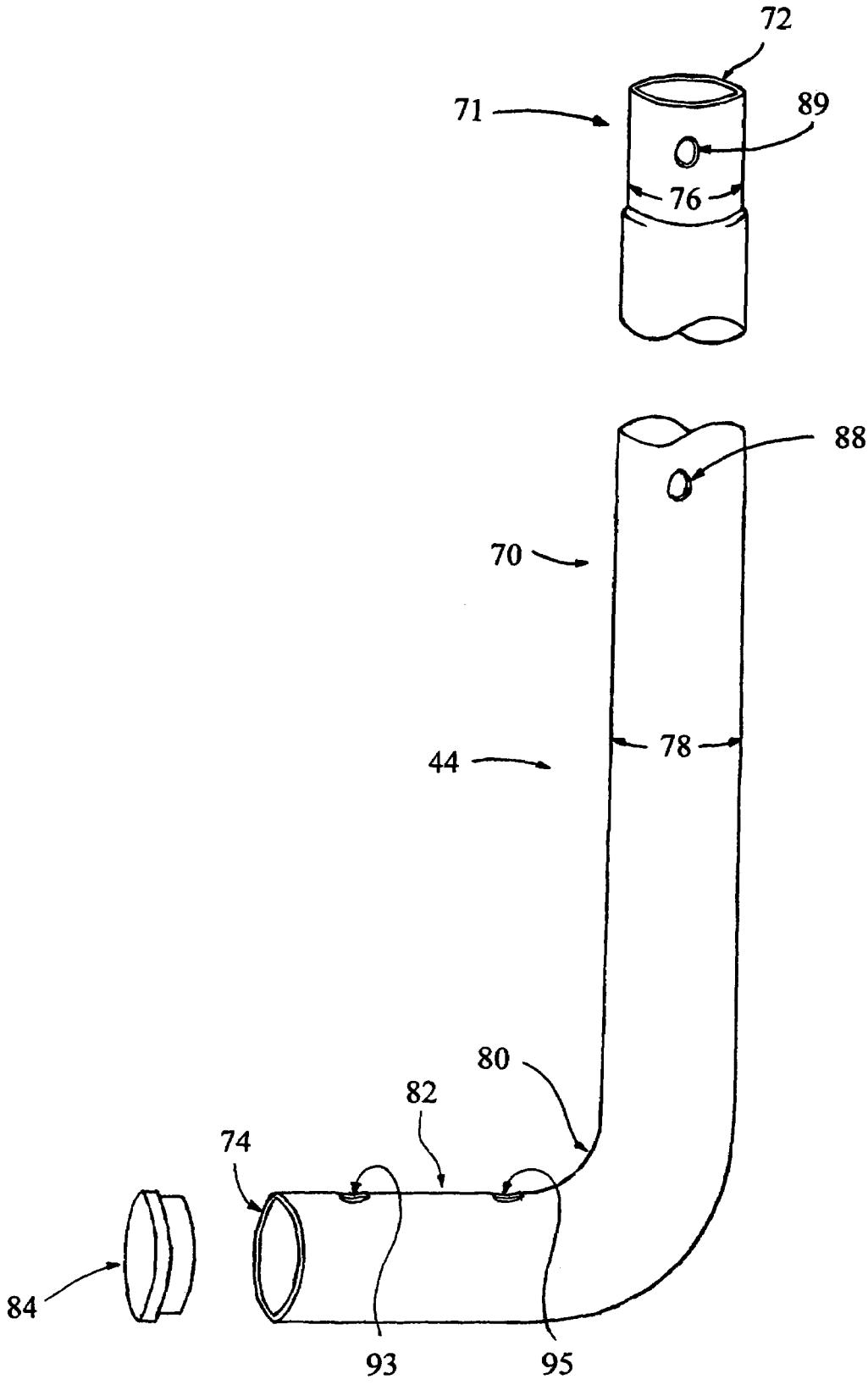
FIG. 4 is a side view of the bottom piece of the second canopy support member.

Referring now to FIG. 4, there is illustrated the bottom foot member (44) of the second canopy supporting member (16). There is shown a first vertical section (70) having a compressed top end (71) and a first end (72) and a second end (74). The tube has a diameter (78) that is consistent along its length. The compressed top end portion (71) has a reduced diameter (76) that is adapted to fit inside of the bottom end (112) of the middle vertical member (42) in a frictional engagement as illustrated on following figures. Bend (80) transitions from the vertical section (70) by way of a ninety degree directional change to horizontal section (82) extending away from the bend a distance suitable to act as a load bearing member for the canopy and transfer the weight of the canopy to the load bearing surface (22). The open second end (74) of the bottom foot member (44) includes cap (84) to cover any sharp edges and to prevent moisture from entering the tube and promoting corrosion. An aperture (88) is shown which extends through the tube vertical member (70) and is adapted to accept fixing means for fixing the top end of the second canopy supporting member stabilizing rod (20). Aperture (89) is included and is adapted to accept fixing means for fixing the bottom member (44) to the middle member (42). Additional apertures (93) and (95) are included and are adapted to receive anchor means for anchoring the canopy support member to the surface upon which the shelter kit is assembled. The surface may be wood, concrete, stone or grass and a person skilled in the art would understand that the anchor means would be, correspondingly, wood screws, concrete screws, or stakes of adequate length to act as suitable anchors. These anchors are included in the kit.

Figure 5:
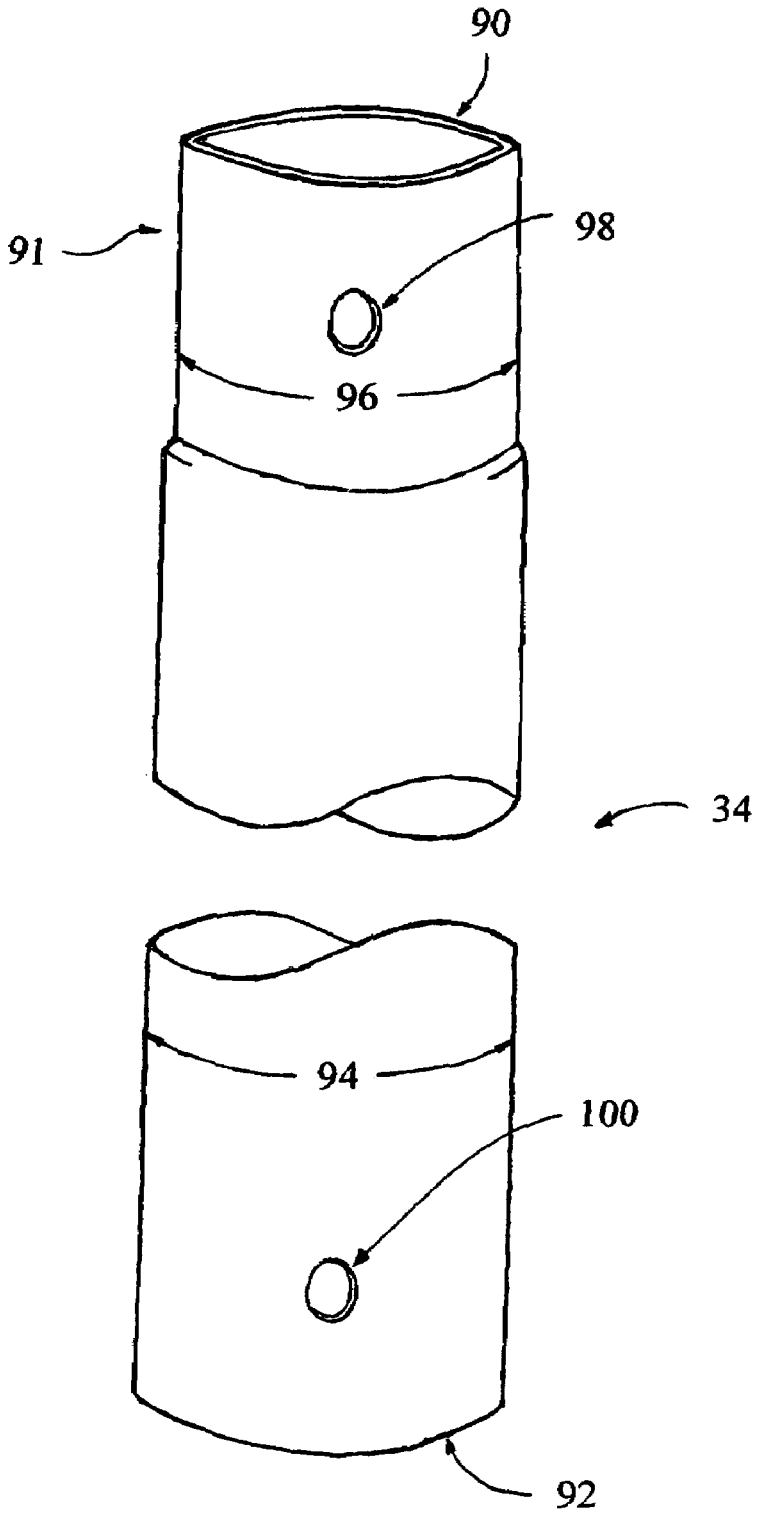
FIG. 5 is a side view of the middle piece of the first canopy support member.

Referring to FIG. 5, there is shown the middle vertical member (34) of the first canopy support member (14). The middle vertical member (34) comprises a first end (90), a compressed top portion (91) and a second end (92). The tube has a diameter (94) that is consistent along its length. The compressed top portion (91) has a reduced diameter (96) and is adapted to mate with the anticlinal cantilevered member (32) as more fully explained below. Aperture (98) is located in the compressed top portion (91) and is adapted to accept fixing means to fix vertical middle member (34) to the anticlinal cantilevered member (32). Aperture (100) is located at the second end (92) and is adapted to receive fixing means for fixing the vertical middle member (34) to the bottom foot member (36).

Figure 6:
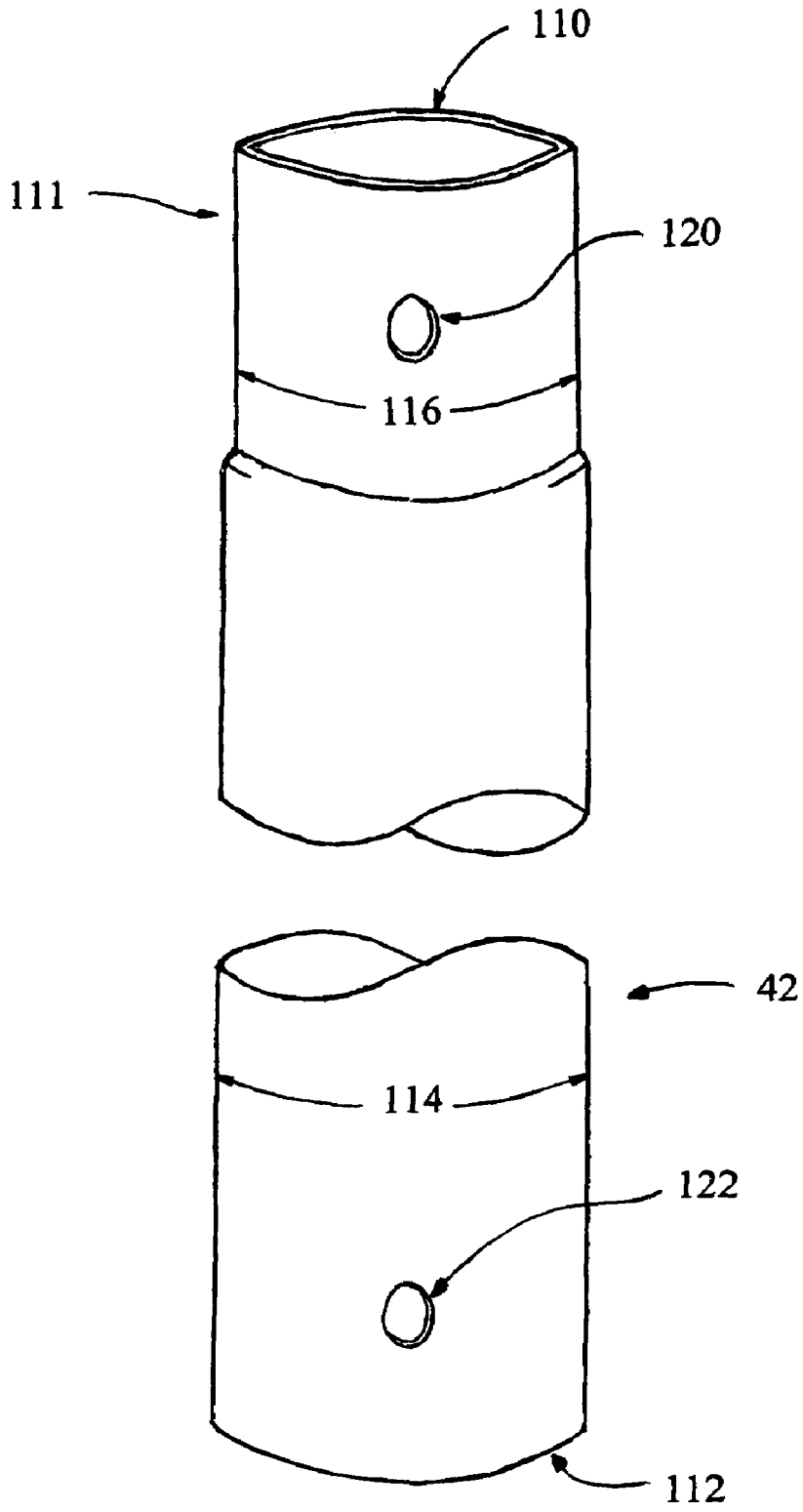
FIG. 6 is a side view of the middle piece of the second canopy support member.

Referring to FIG. 6, there is shown the middle vertical member (42) of the second canopy support member (16). The middle vertical member (42) comprises a first end (110) and a second end (112). The tube has a diameter (114) that is consistent along its length. The compressed top portion (111) has a reduced diameter (116) and is adapted to mate with the anticlinal cantilevered member (40) as more fully explained below. Aperture (120) is located in the compressed portion (111) and is adapted to accept fixing means to fix vertical middle member (42) to the anticlinal cantilevered member (40). Aperture (122) is located at the second end (112) and is adapted to receive fixing means for fixing the vertical middle member (42) to the bottom member (44).

Figure 7:
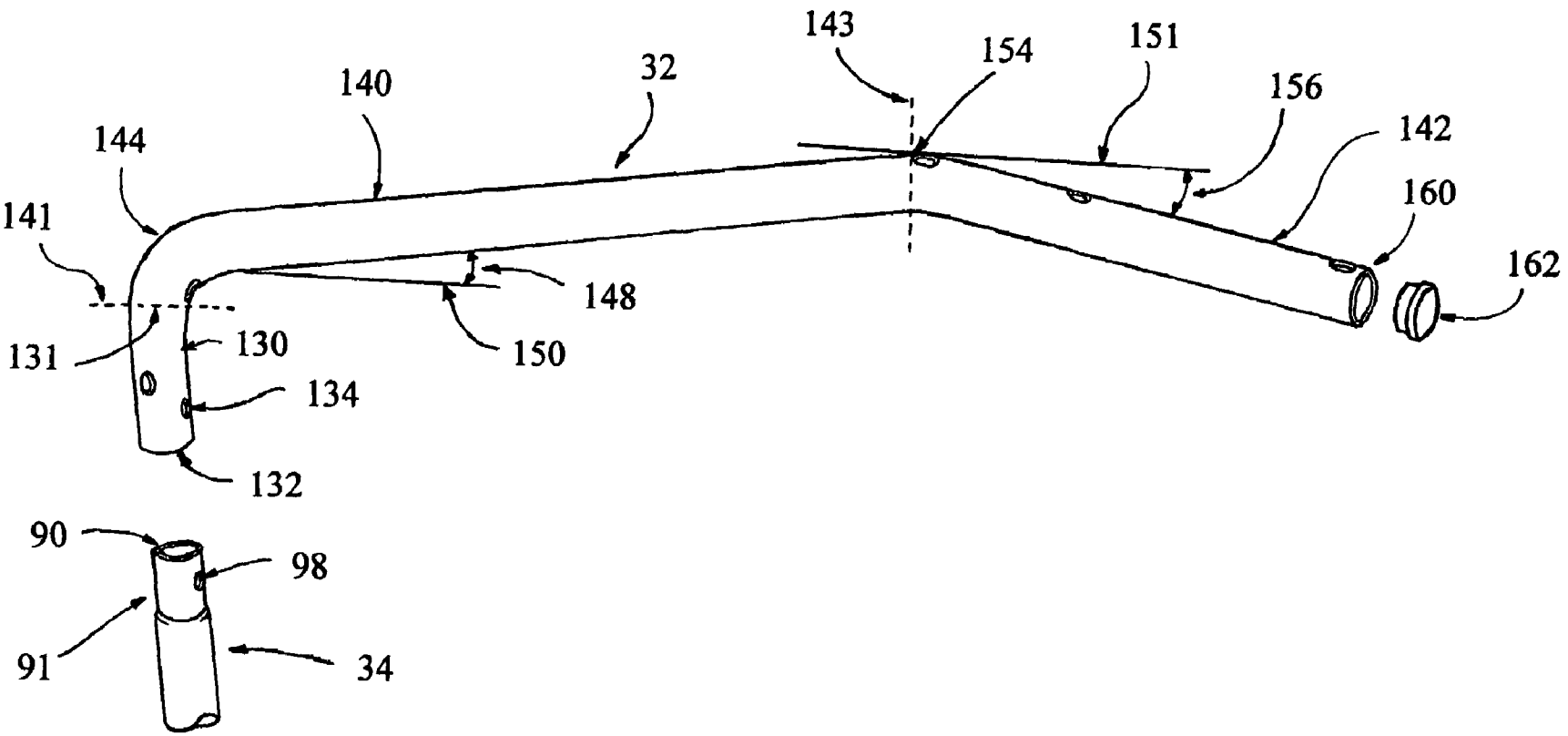
FIG. 7 is a side view of the top cantilevered piece of the first canopy support member.

Now referring to FIG. 7, there is illustrated the first anticlinal cantilever member (32). The first anticlinal cantilever member comprises three sections that are integral and contiguous and form a single tubular member. There is a first vertical section (130), a second section (140) and a third section (142). Sectional borders are delineated by the dashed lines (141) and (143). The first vertical section (130) has a bottom open end (132) and a top end (131) that is integral to the second section. The open bottom end is adapted for mating with the compressed portion (91) of middle vertical member (34) in a slip joint manner. The bottom end (132) is apertured at (134) so that when the middle vertical member (34) is mated with the bottom of the first vertical section (130) aperture (134) and aperture (98) are co-axial and adapted to receive fixing means for fixing the two members together. The second section (140) depends upwardly and outwardly from the top end (131) through first bend (144). The second section has a positive acclivity (148) from the horizontal (150). The positive acclivity is about 15 degrees and is adapted to provide for additional height to the canopy over the barbeque and to provide a sloped surface for the canopy to shed moisture and dirt that might otherwise accumulate on the canopy. The second section (140) terminates at second bend (154) where the third section (142) commences. Third section (142) has a negative acclivity (156) depending from the horizontal (151). The negative acclivity is about 15 degrees and is adapted to provide a reverse slope to the canopy to shed moisture and dirt that might otherwise accumulate. The third section (142) terminates in an open second end (160) which has cap (162) for covering the open end against moisture accumulation and to protect the canopy fabric from sharp edges.

Figure 8:
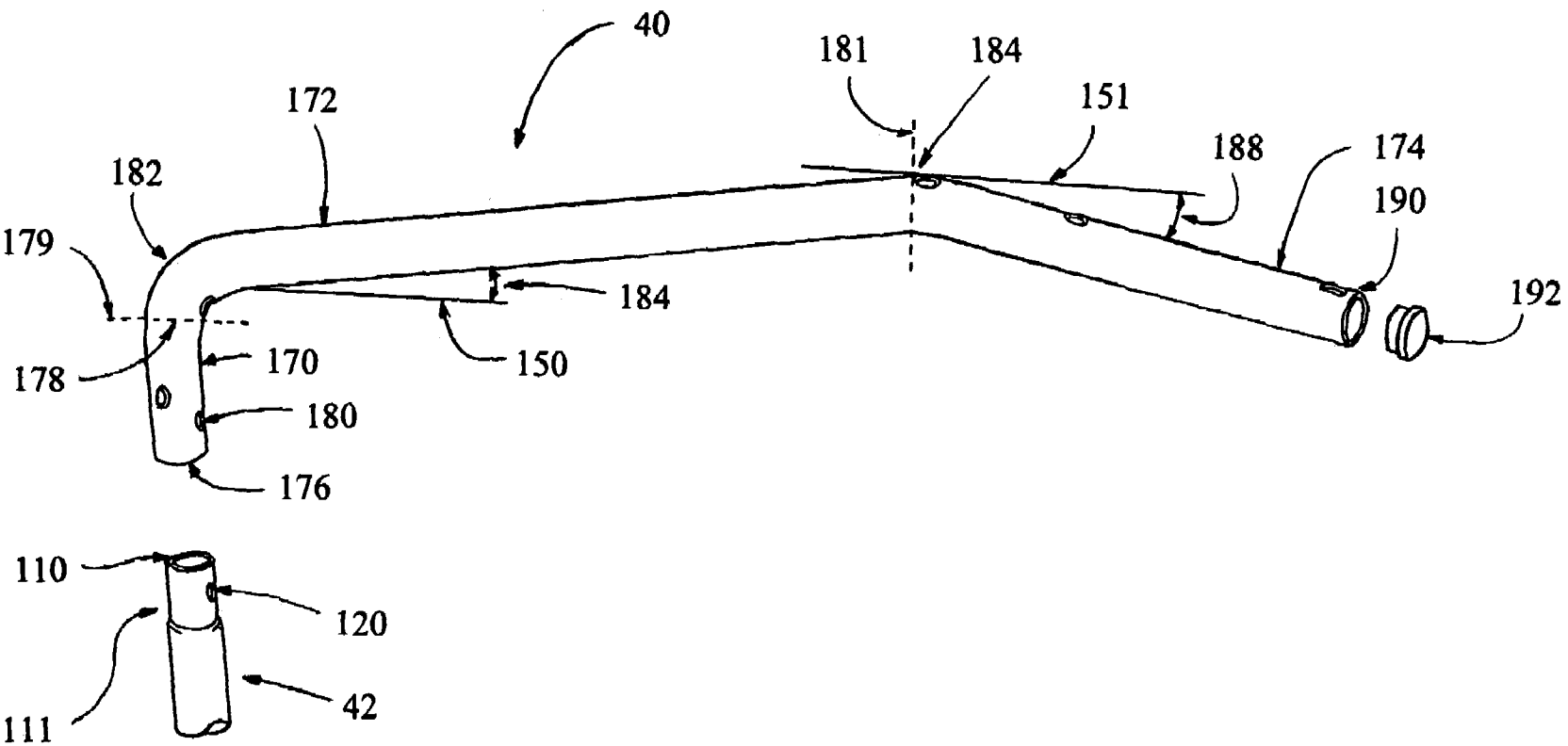
FIG. 8 is a side view of the top cantilevered of the second canopy support member.

Now referring to FIG. 8, there is illustrated the second anticlinal cantilever member (40). The second anticlinal cantilever is identical to the first anticlinal cantilever member and comprises three sections that are integral and contiguous and form a single tubular member. There is a first vertical section (170), a second section (172) and a third section (174). The first vertical section (170) has a bottom open end (176) and a top end (178) that is integral to the second section (172). These sections are delineated by the dashed lines (179) and (181). The open bottom end (176) is adapted for mating with the compressed portion (111) of middle vertical member (42) in a slip joint manner. The bottom end (176) is apertured at (180) so that when the middle vertical member (42) is mated with the bottom of the first vertical section (176) aperture (120) and aperture (180) are co-axial and adapted to receive fixing means for fixing the two members together. The second section (172) depends outwardly and upwardly from the top end (178) through first bend (182). The second section has a positive acclivity (184) from the horizontal (150). The positive acclivity is about 15 degrees and is adapted to provide for additional height to the canopy over the barbeque and to provide a sloped surface for the canopy to shed moisture and dirt that might otherwise accumulate on the canopy. The second section (172) terminates at second bend (184) where the third section (174) commences. Third section (174) has a negative acclivity (188) depending from the horizontal (151). The negative acclivity is about 15 degrees and is adapted to provide a reverse slope to the canopy to shed moisture and dirt that might otherwise accumulate. The third section (174) terminates in an open second end (190) which has cap (192) for covering the open end against moisture accumulation and to protect the canopy fabric against sharp edges.

Figure 9:
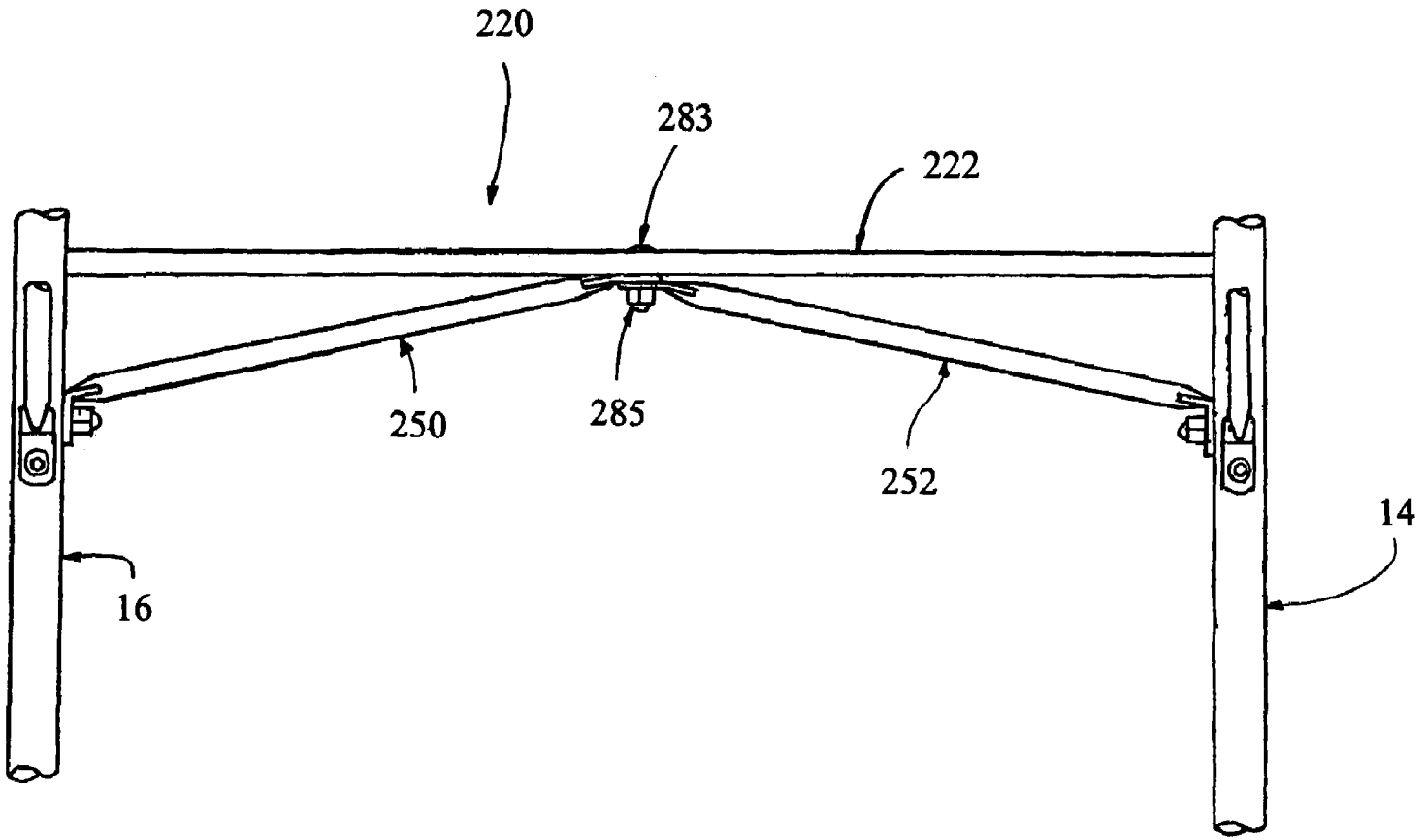
FIG. 9 is a rear view of the assembled shelter kit showing detail of the reinforcing rods.

Referring now to FIG. 9, there is shown a partial rear view of the shelter kit assembled and mounted to a surface. To provide further lateral stability to the structure, there is providing bracing means (220) between the first (14) and second (16) canopy supporting members. The bracing means comprise a first lateral bracing rod (222) extending between the first (14) and second (16) canopy supporting members.

Figure 10:
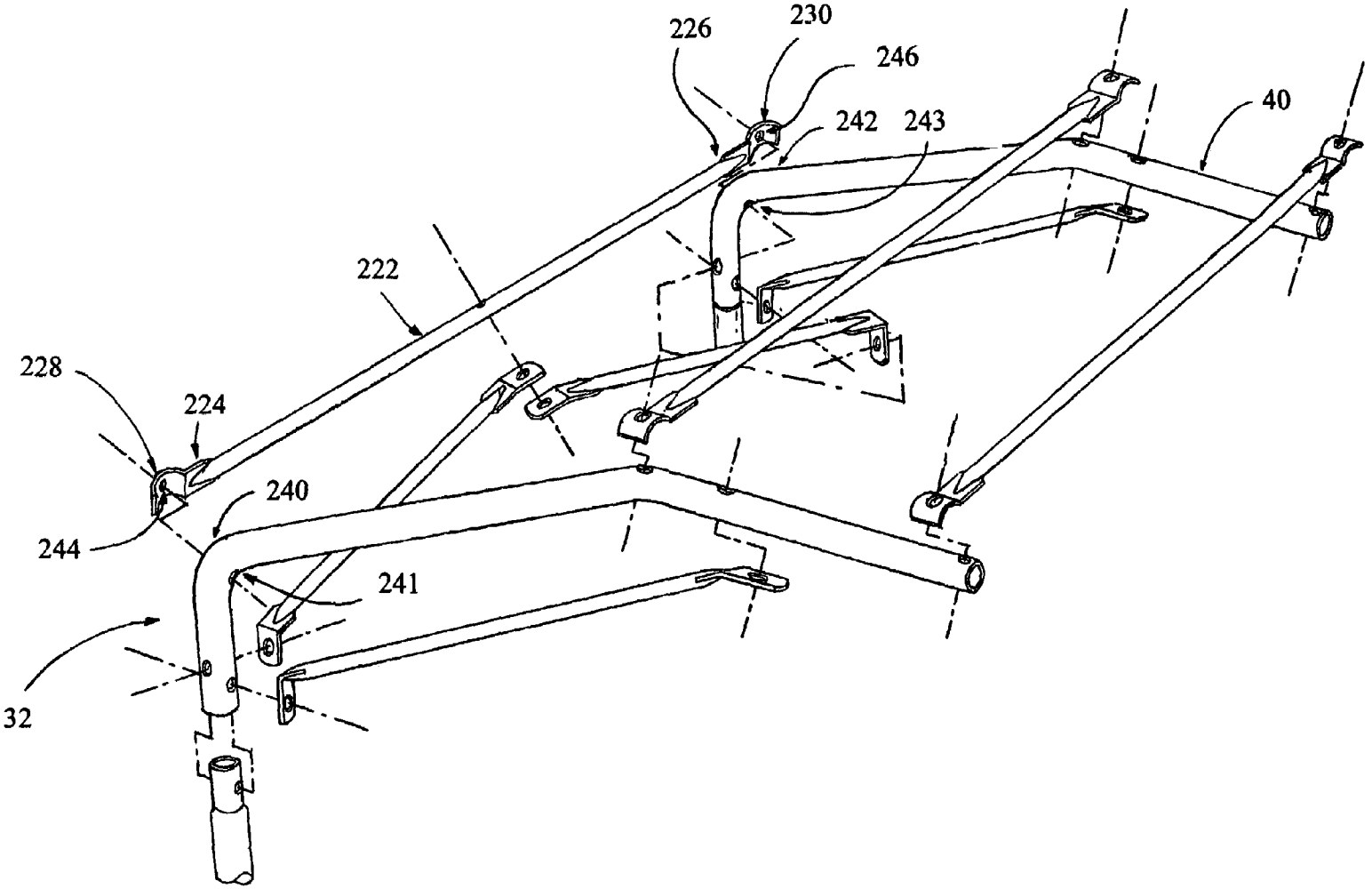
FIG. 10 is a partial assembly drawing showing the relationship between the support rods of the shelter kit.

Referring to FIG. 10, first rod (222) has a first end (224) and a second end (226). First rod first end (224) and first rod second end (226) are swaged at (228) and (230) respectively. Each swage (228) and (230) is curved to adapt to the curved outer surface (240) of the first (32) and (242) of the second (40) canopy supporting members. Each swage is apertured at (244) and (246) respectively and the apertures are adapted to receive fixing means to fix the rod (222) to the first (32) and second (40) canopy supporting members through apertures (241) and (243) respectively.

Figure 11:
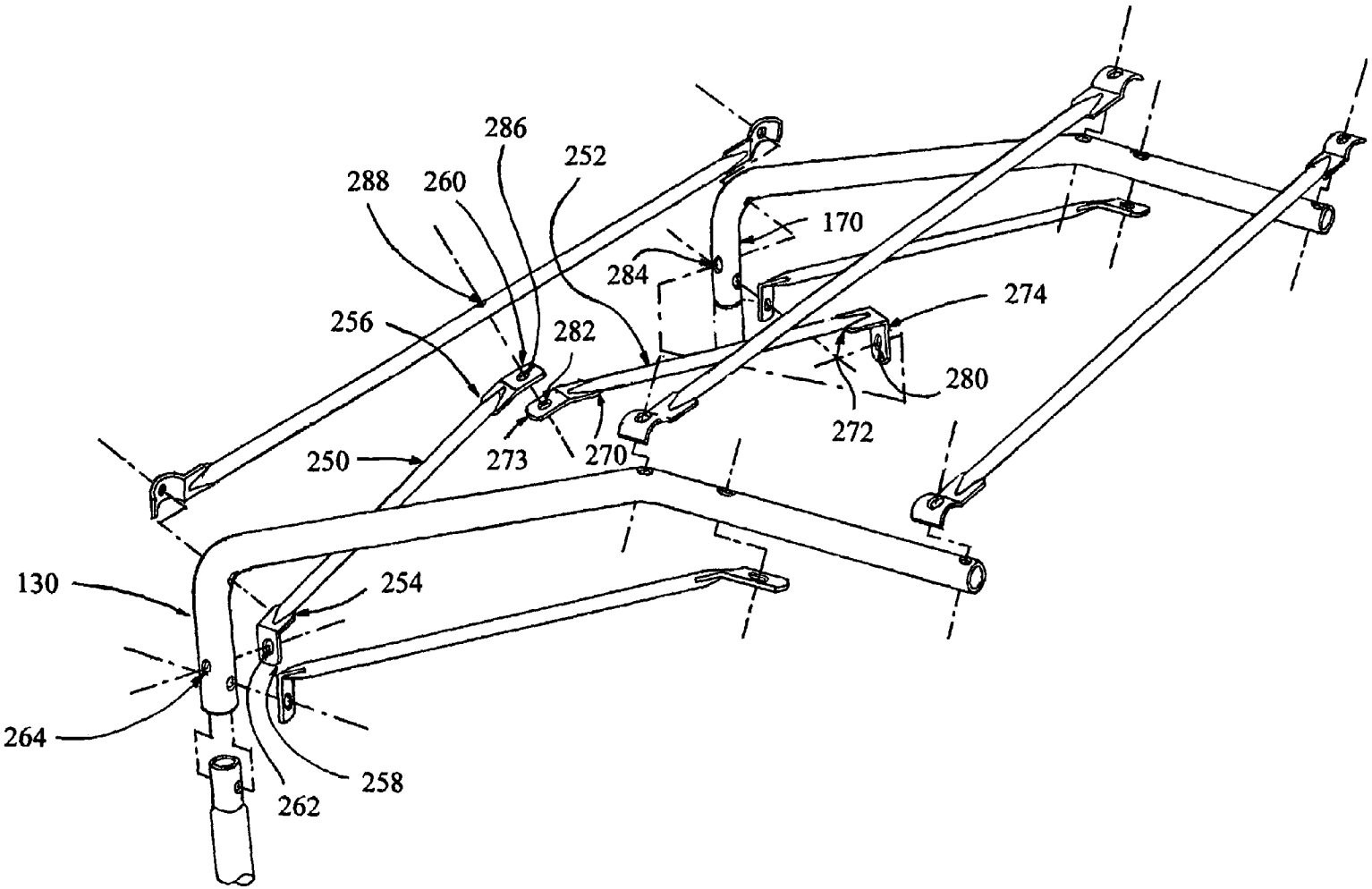
FIG. 11 is the same drawing as FIG. 10.

Referring to FIG. 11, bracing means (220) are further described and adapted to provide lateral support to the first (14) and second (16) canopy supporting members. These are rods (250) and (252) which are joined to rod (222) at its midpoint. Rod (250) has a first end (254) and a second end (256). First end (254) is swaged (258) and depends at an angle from the longitudinal axis of the rod so that the swage (258) is parallel to the vertical section (130) of the cantilever member (32) of the canopy supporting member (14). The opposite end (256) of rod (250) is also swaged at (260). Swage (260) depends downwards from the longitudinal axis of the rod so that when the rod first end swage (258) is fixed to the canopy supporting member vertical section (130) swage (260) is horizontal. Swage (258) is apertured (262) to receive fixing means and so that when the swage (258) is against the vertical section (130) of the cantilever member (32) aperture (262) will be adjacent to and coaxial with aperture (264) on the vertical section (130). Rod (252) has a first end (270) and a second end (272) each including a swage (273) and swage (274) respectively. Swage (274) depends downwards from the longitudinal axis of the rod so that when the rod second end is fixed to the canopy supporting member (40) the swage (274) is vertical. End (270) swage (273) depends at an angle from the longitudinal axis of the rod so that when the swage (274) is parallel to the vertical section (170) of the cantilever member (40) swage (273) is horizontal. Swage (274) is apertured (280) to receive fixing means and so that when the swage is against the vertical section (170) of the cantilever member (40) aperture (284) will be adjacent to and coaxial with aperture (280) for receiving fixing means.

First rod (250) and second rod (252) are joined at swages (260) and (273). The joined swages lie midway between the first and second canopy supporting members. The resulting acclivity of each of the rods (250) and (252) provides for stability of the first and second canopy supporting members and overall structural strength. When rod (250) and (252) are joined, apertures (282), (286) and (288) are co-axial and adapted to receive fixing means, shown as a bolt (283) and nut (285) combination in FIG. 9.

Figure 12:
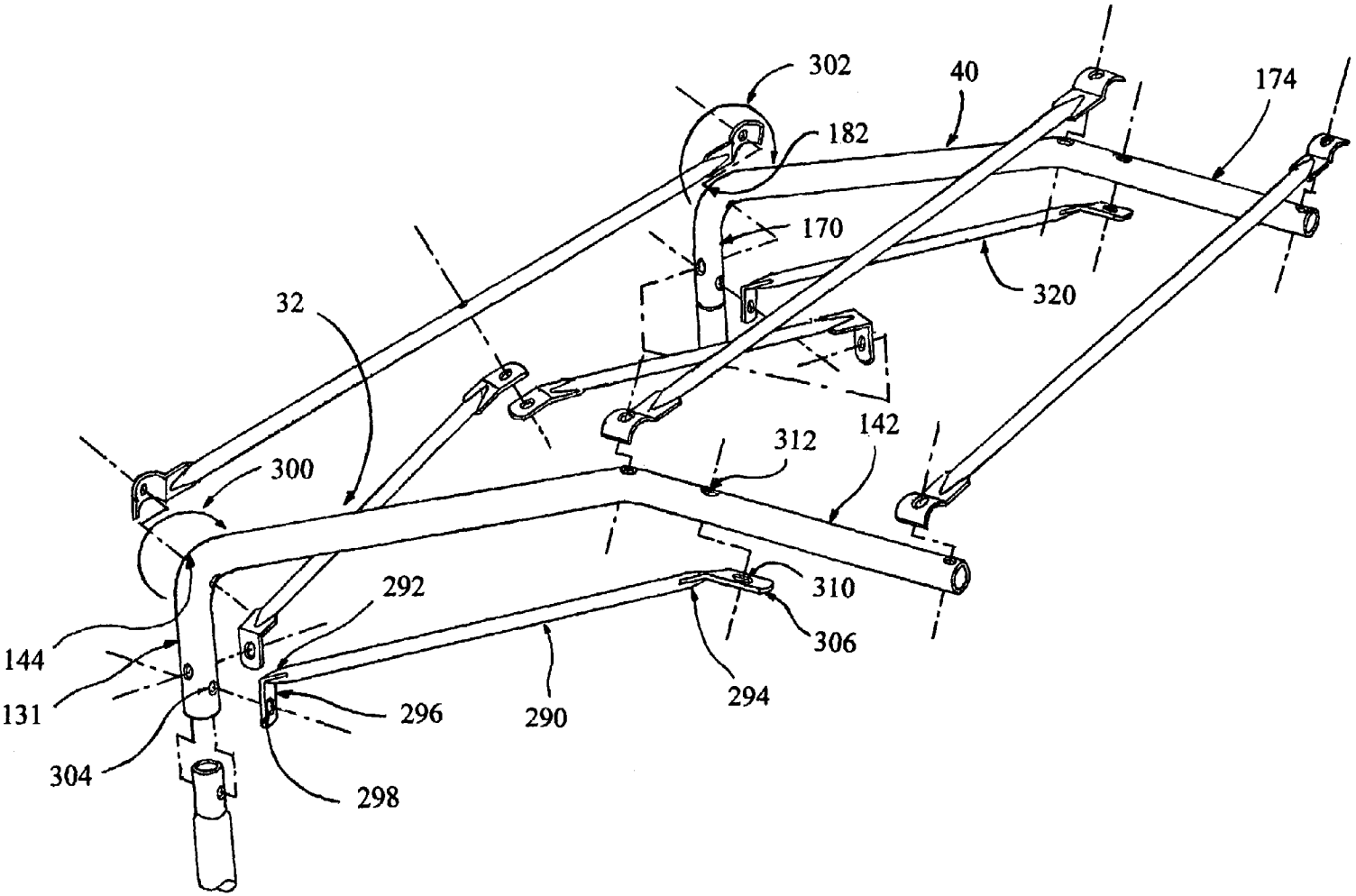
FIG. 12 is the same drawing as FIG. 10.

Referring to FIG. 12, the weight of the canopy will create moments (300) and (302) about the cantilevered members (32) and (40) respectively of the canopy support members (14) and (16). Without additional bracing these moments will cause unwanted flexure about bends (144) and (182) and could result in failure of the members. Therefore, my shelter kit includes a pair of moment resisting rods. The first moment resisting rod (290) is placed in a supporting relationship between the third section (142) of the cantilever (32) and the vertical section (131) of the cantilever member (32). Rod (290) has a first end (292) and a second end (294). The first end (292) is swaged at (296). The first end swage (296) depends at an angle downwards from the longitudinal axis of the rod so that the swage (296) may be placed adjacent to and parallel to vertical section (131) of cantilever member (32). The swage is apertured (298) to receive fixing means. When the swage (296) is in place against the vertical section (131), the aperture (304) in the first rod is adjacent to and co axial with the aperture (298) in swage (296). The bracing rod second end (294) is also swaged at (306). Swage (306) depends at an angle downwards from the longitudinal axis of the rod so that it can sit adjacent to the bottom surface of the third section (142) of the cantilevered member (32). The swage (306) is apertured at (310). When swage (306) is placed up against the bottom surface of section (142) swage aperture (310) is adjacent to and co axial with aperture (312) and adapted to receive fixing means to fix the rod (290) to the member (32).

An identical second bracing rod (320) is adapted to be fixed in an identical manner between the section (184) of the anticlinal cantilever member (40) of the second canopy support member (16) and its corresponding vertical member (170).

Figure 13:
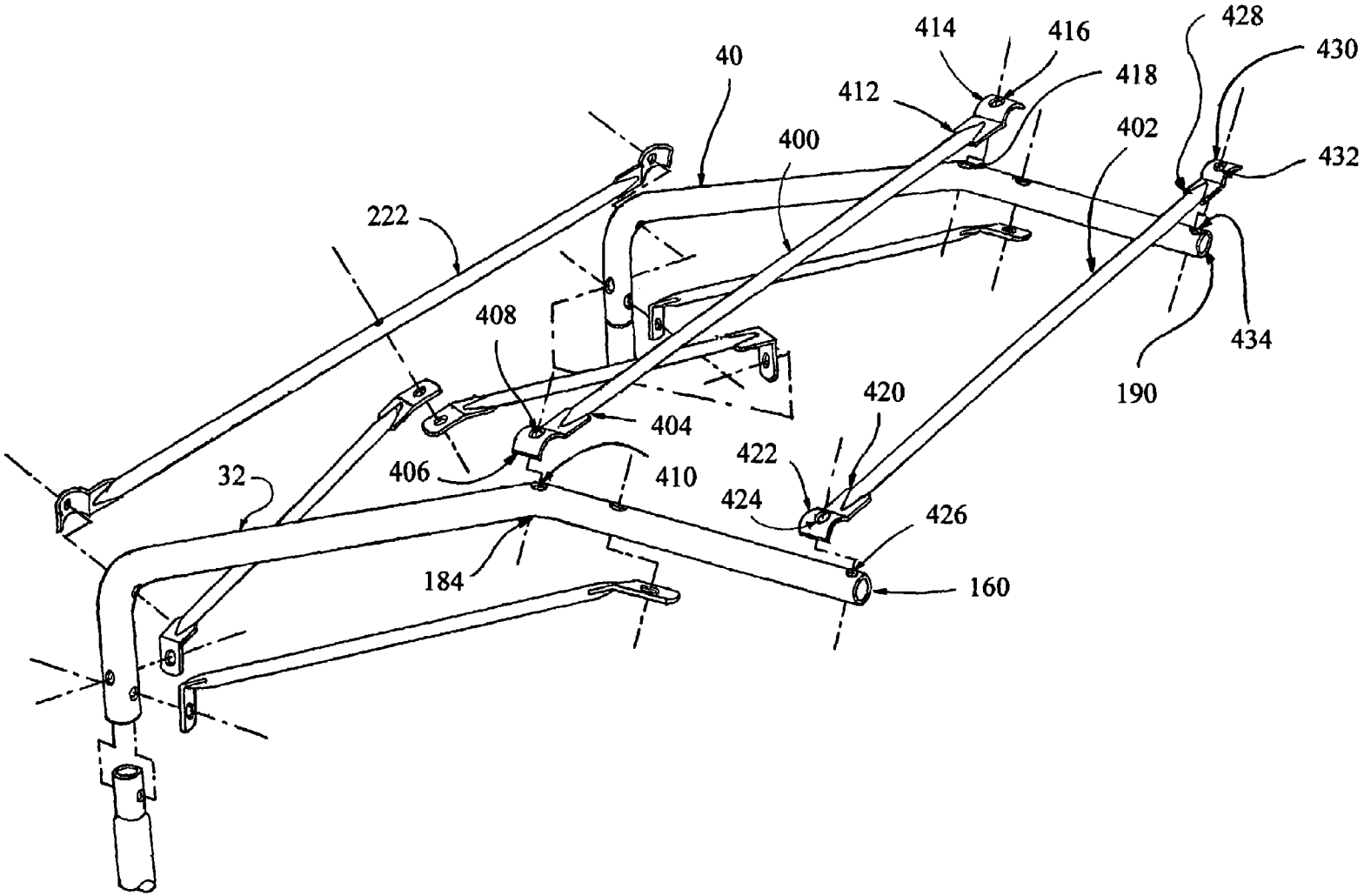
FIG. 13 is the same drawing as FIG. 10.

Referring now to FIG. 13, to provide structural support to the canopy and to transfer the weight of the canopy to the cantilevered canopy support members (32) and (40) there are two additional rods (400) and (402). Rods (400) and (402) are identical to rod (222). Rod (400) has a first end (404) with a swage (406) that is curved to fit over the curved surface of the cantilevered support member (32) at bend (154). There is an aperture through bend (154) at (410). The swage (406) is apertured at (408). When rod (400) is installed, aperture (408) and aperture (410) are co-axial and adapted to receive fixing means to fix rod (400) to member (32). Similarly, rod (400) has a second end (412). Second end (412) is swaged (414) and the swage is apertured at (416). Swage (414) is curved to adapt to the curved surface of member (40). When rod (400) is installed on member (40) the swage aperture (416) is coaxial with aperture (418) at bend (184). The apertures and adapted to receive fixing means to fix rod (400) to member (40).

Still referring to FIG. 13, there is shown the placement of the third rod (402) between the end (160) of member (32) and the end (190) of member (40). Rod (402) has a first end (420) that is swaged at (422). The swage is curved and adapted to fit over the curved surface of member (32). The swage is apertured at (424). When rod (402) is fixed to member (32) aperture (424) is coaxial with aperture (426) in member (32). Both apertures are adapted to receive fixing means for fixing rod (402) to member (32). Similarly, rod (402) has a second end (428) having a swage (430). Swage (430) is apertured (432) and curved to fit over member (40). Member (40) is apertured at (434) and when rod (402) is placed upon member (40) apertures (432) and (434) are coaxial and adapted to receive fixing means to fix rod (402) to member (40).

Figure 3:
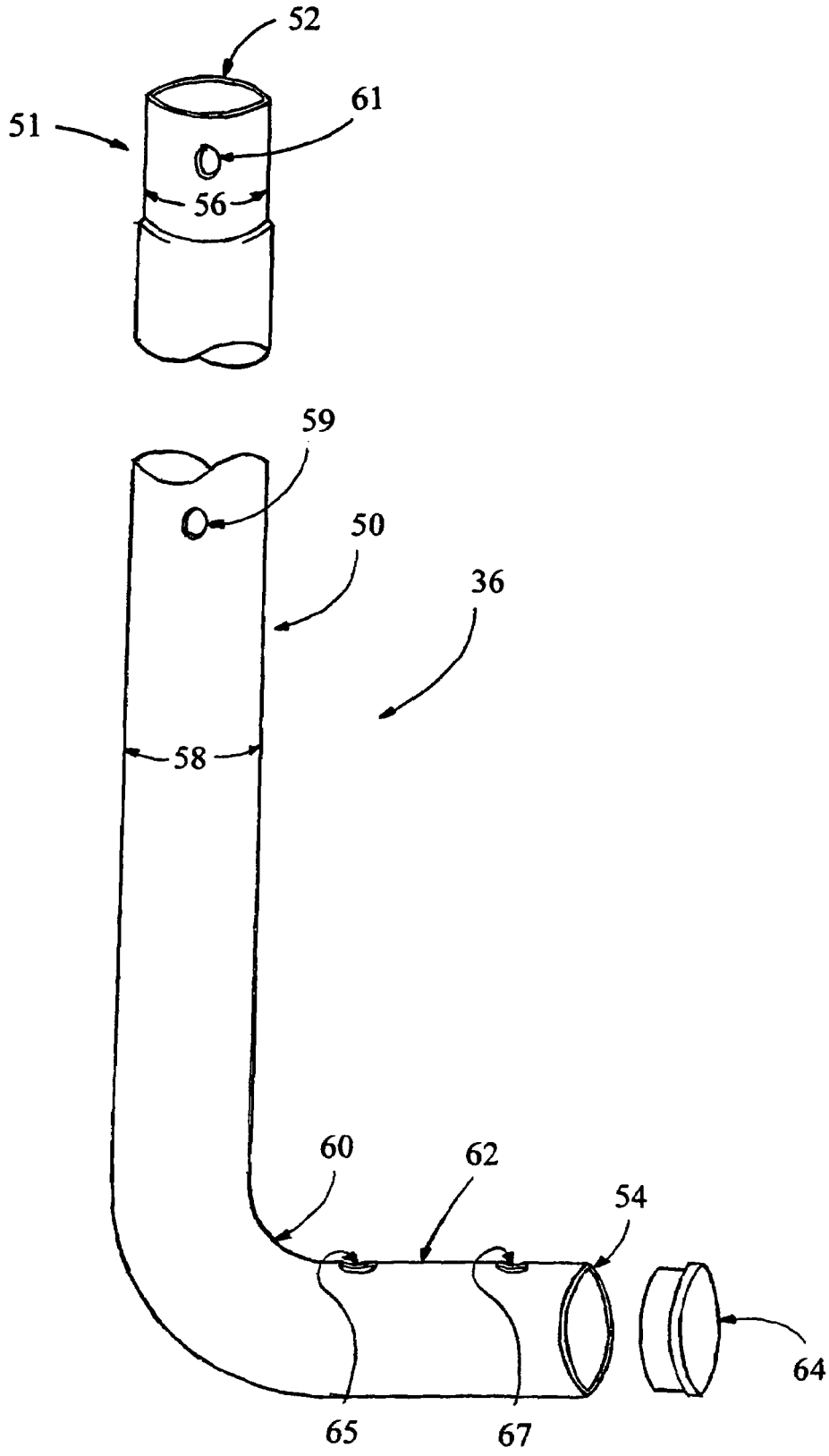
FIG. 3 is a side view of the bottom piece of the first canopy support member.
Figure 14:
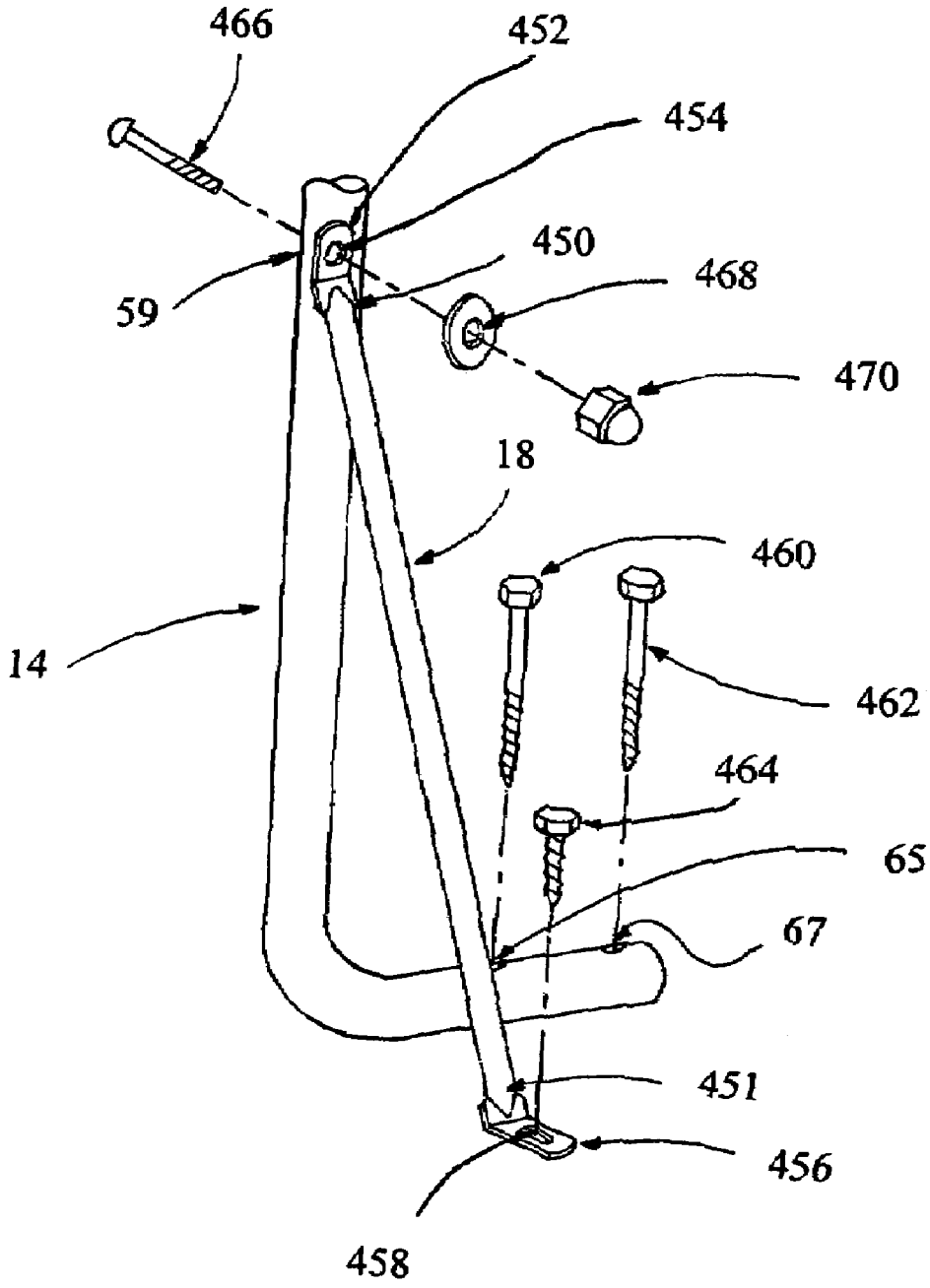
FIG. 14 is a view of the support brace for the bottom foot member of the canopy support members.

Referring now to FIG. 14, there is shown the manner in which first (14) and second (16) cantilever support members are stabilized. First member (14) includes a first member stabilizing rod (18) having a first end (450) and a second end (451). First end (450) is swaged at (452). The swage (452) depends from the longitudinal axis of rod (18) so that when the swage (452) is against the vertical surface of member (14) the swage and member are parallel. Swage (452) is apertured at (454) and member (14) is apertured at (59—refer to FIG. 3). When rod (18) is placed against member (14) aperture (454) and aperture. (59) are coaxial and adapted to receive fixing means shown as bolt (466), washer (468) and nut (470) for fixing rod (18) to member (14). Rod (18) second end (451) is swaged at (456). Swage (456) is apertured at (458) and depends downward from the longitudinal axis of rod (18) so that when rod (18) first end (450) is fixed to member (14) swage (456) is horizontal to the surface upon which the shelter rests. Depending upon the surface that the shelter is mounted upon, the rod (18) second end (456) fixing means (464) is used to anchor rod (18) to that surface. In the embodiment shown, fixing means (464) is shown as a wood screw that would be suitable for mounting the shelter to a wooden deck. However, the fixing means may be concrete screws or anchors for concrete or stone surfaces or even stakes or nails for anchoring rod (18) onto a grass surface.

Referring to FIG. 1, rod (20) is attached to member (16) and surface (22) in the same manner described above for rod (18). Rod (20) and rod (18) are identical in size and function.

Figure 15:
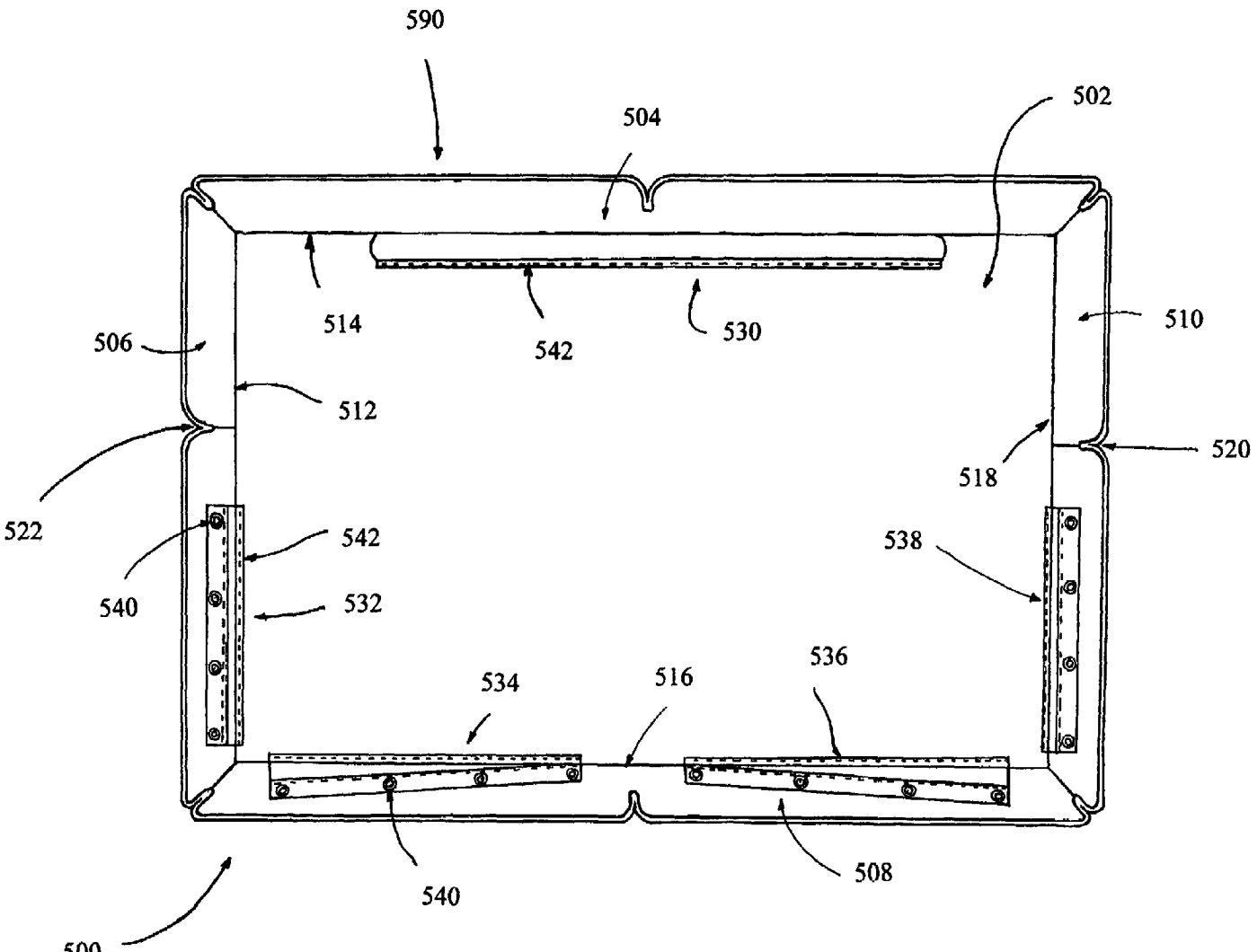
FIG. 15 is an underside view of the canopy.

Referring now to FIG. 15, there is shown the construction of the canopy (500) of my invention. FIG. 15 is a view of the bottom of the canopy. Canopy (500) is a rectangular structure having a sheltering rectangular sheet (502) and four valences (504), (506), (508) and (510) depending from each of the sides of the rectangular sheltering surface. The canopy fabric, which as indicated above, is preferably a synthetic tent fabric sold under the name Mardi Gras®, can be easily stitched with a sewing machine. Each of the valences are sewn onto the sheltering surface (502) and the stitch lines are shown as (512), (514), (516) and (518) and are adapted to act as flexure lines that permit the valences to drape downwards in an attractive fashion. The valences shown in this embodiment have features such as the convolutions shown at (520) and (522) to accommodate the necessary angles that will be imparted into the canopy by the angles of the anticlinal cantilevered support members (32) and (40). It is also to be understood that a variety of aesthetic features may be imparted to the valences. In the alternative, the valences may be heat fused to the sheltering surface edges. The valences are generally about 7 to 8 inches in width and may be trimmed with additional fabric for aesthetic purposes. While the valences may be made from the same 13 ounce material as the sheltering surface, it can be made of a lighter fabric such as 10 ounce fabric.

The rectangular sheltering sheet (502) when installed upon the canopy supporting members will lie upon first, second and third lateral bracing rods (222), (400) and (402) respectively for support. To fix the canopy to the structural support frame (30—refer to FIG. 2), there are a plurality of flaps (532), (534), (536) and (538) fixed to the bottom edges of the sheltering rectangular sheet (502) and depending downwards from the bottom surface of the sheltering rectangle. The flaps are fabricated from the same 13 ounce fabric used to fabricate the sheltering rectangular sheet (502). The flaps are formed by double-folding the fabric and stitching the fold in place. The double folds create a strong base upon which to fix a linear parade of spaced grommets (540). Each grommet creates an aperture through which a rope may pass as further explained below. There is also provided a sleeve structure (530) has is fabricated from the same 13 once material used to fabricate the sheltering rectangular sheet. The sleeve is formed by folding the fabric over and sewing it in place. The sleeve is adapted to receive rod (402) in order to hold the front end (590) of the sheltering rectangular sheet in place. As FIG. 15 illustrates by stitching lines (542), the flaps and sleeve can be stitched to the sheltering rectangular sheet but it should also be understood that they can be heat-fused to the sheltering rectangular sheet.

Figure 16:
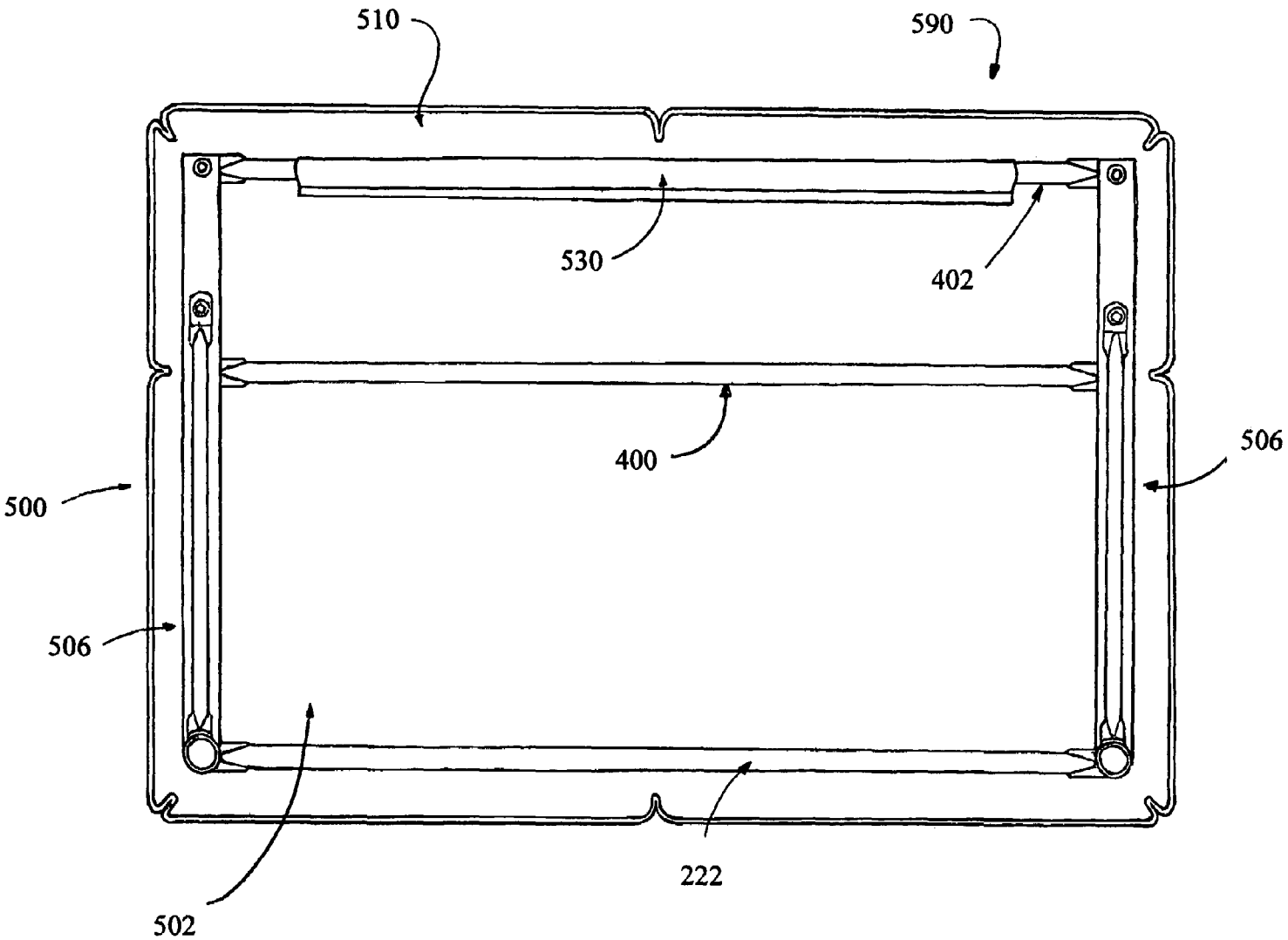
FIG. 16 is an underside view of the canopy fixed to the canopy support structure.

Referring to FIG. 16, there is shown a bottom view of the canopy (500) placed upon the canopy support structure. Rod (222) and rods (400) and (402) support the canopy sheltering rectangular sheet (502). Sleeve (530) receives rod (402) to fix the front of the canopy (590) to the supporting structure. Valences (506), (510) and (506) are shown in an overhanging relationship with the support structure.

Figure 17:
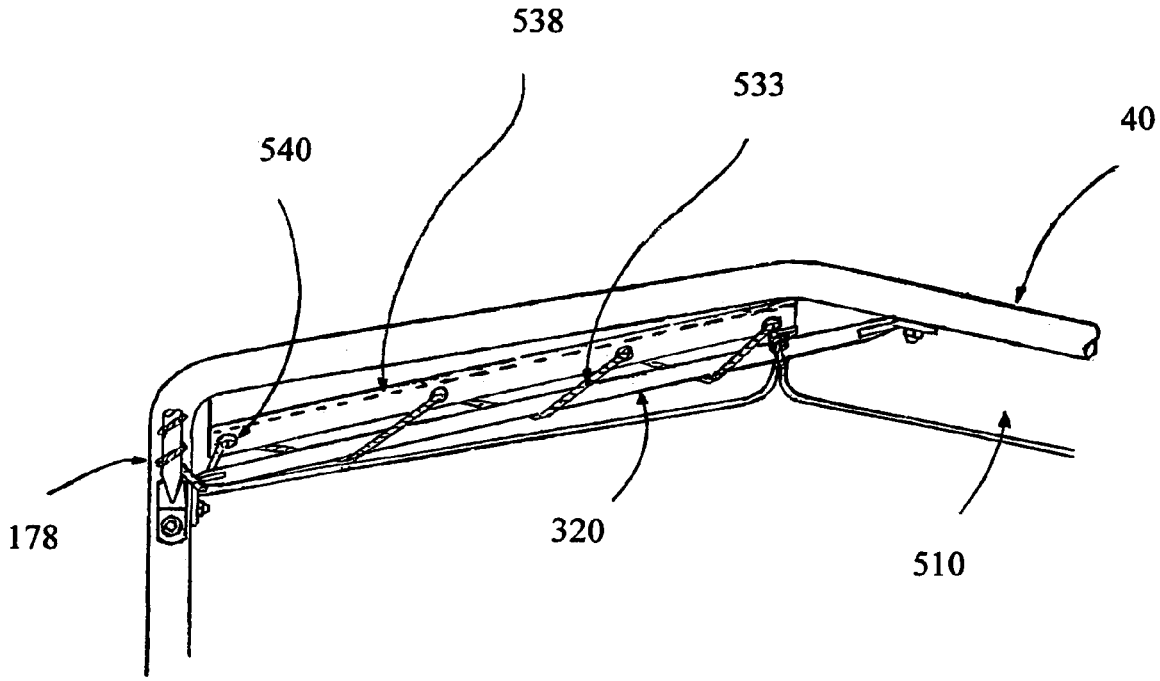
FIG. 17 is a side inside view of one of the cantilevered support members showing how the canopy is fixed to the support structure.

Referring to FIG. 17, the canopy is placed upon the canopy support structure and the observer is looking from the inside of the canopy towards member (40). Bracing rod (320) is also shown. Flap (538) is shown depending down from the bottom of the sheltering rectangle (502). Note that flap (538) has the same positive acclivity as the bracing rod (320) so that the parade of grommets (540) is substantially parallel to the bracing rod. As shown, there is a rope (533) that is used to wrap around the bracing rod and through the grommets so that the sheltering rectangle can be fixed to the supporting structure. Valence (510) is shown depending from the edge of the sheltering rectangular sheet (502). On the opposite side, the canopy is fixed to brace (290) by way of depending flap (540) and another rope. The rope is generally a nylon rope.

Figure 18:
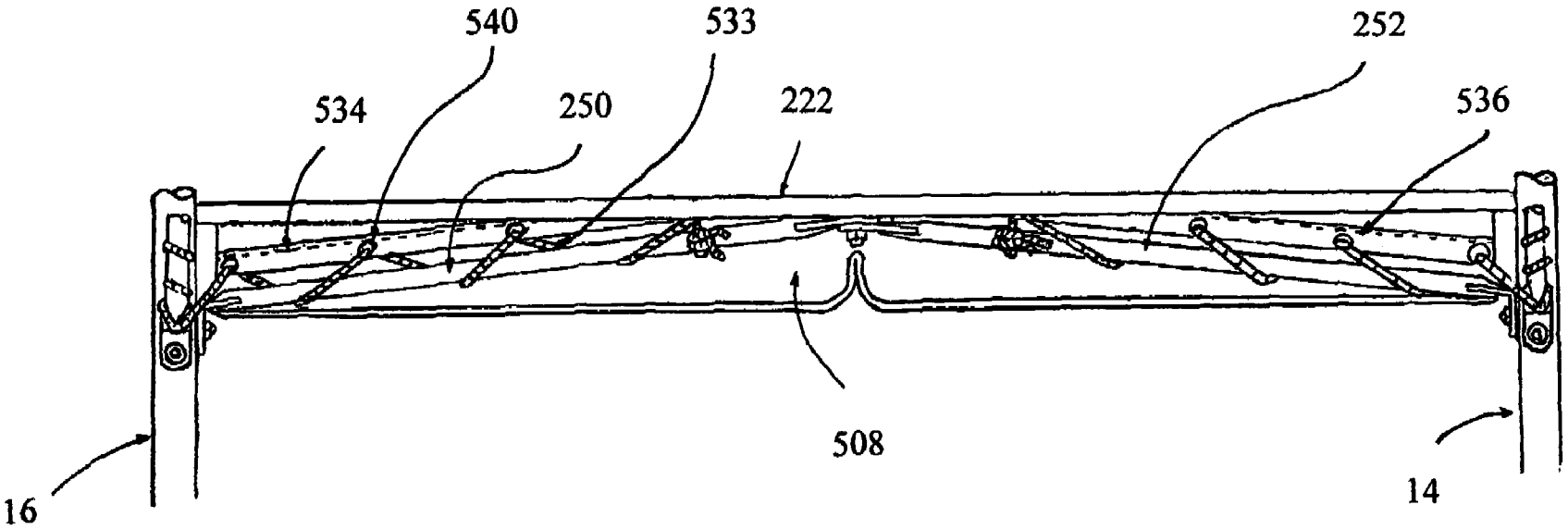
FIG. 18 is a rear inside view of the canopy support structure showing how the canopy is fixed to the support structure.

Referring to FIG. 18, there is shown the back end of the canopy and how it is fixed to bracing rods (250) and (252). The viewer is on the inside of the shelter and looking towards the back of the shelter. Rod (222) is shown and is adapted to support the back end of the sheltering rectangular (502). Depending flaps (534) and (536) are shown depending down from the back end of the sheltering rectangular sheet. The depending flaps have an acclivity that is adapted to match the acclivity of the bracing rods (250) and (252) to which they are attached so that the parade of grommets (540) are on each of the depending flaps are parallel to their respective adjacent bracing rod. Rope (533) is used to tie the depending flaps to the bracing rods as shown and in this way the back end of the shelter rectangular sheet is fixed to the support structure. Depending valence (508) is also shown.

Optionally, my shelter kit may include a first draping side wall; a second draping side wall; and, a draping rear wall.

Although this description has much specificity, these should not be construed as limiting the scope of the invention but as merely providing illustrations of some of the presently preferred embodiments of this invention. Thus the scope of the invention should be determined by the appended claims and their legal equivalents, rather than by the examples given.

What is claimed is:

1. A dismountable outdoor shelter kit for mounting upon an outdoor surface, said shelter kit comprising:

a. an anticlinal canopy having an apex for shedding water and dirt, and for providing shelter from the sun, wherein said anticlinal canopy is sufficiently dimensioned to provide for an adequate outdoor sheltered area for barbequing operations;

b. an anticlinal canopy support structure comprising:

i. a first canopy supporting member;

ii. a second canopy supporting member identical to said first canopy supporting member;

iii. a first canopy supporting member stabilizing rod having a first end and a second end;

iv. a second canopy supporting member stabilizing rod identical to said first canopy supporting member stabilizing rod;

v. a plurality of bracing rods for providing stability to said first and second canopy supporting members; and, vi. fixing means for fixing said plurality of bracing rods to said first and second canopy supporting members.

2. The shelter kit as claimed in claim 1 wherein each of the first and second canopy supporting members comprise, respectively:

a. a first and a second bottom foot member each adapted for transferring structural loads from said anticlinal canopy to said outdoor surface, wherein, said first and said second bottom foot member are inwards facing;

b. a first and a second middle vertical member respectively mated to the first and the second bottom foot members; and, c. a first and a second anticlinal cantilevered member adapted to support said anticlinal canopy, wherein said first and said second anticlinal cantilevered members are mated to, respectively, said first and said second middle vertical members.

3. The shelter kit as claimed in claim 2 wherein the first bottom foot member and the second bottom foot member are identical and wherein each of the first and second bottom foot members comprise:

a. a vertical section having a open top end and a compressed top end portion wherein said compressed top end portion is adapted for mating with its adjacent middle vertical member;

b. a bend located below said vertical section, said bend adapted to transition the vertical section through an angle of ninety degrees to;

c. a horizontal section, wherein said horizontal section extends away from said bend a predetermined distance adequate to provide sufficient load bearing capacity to its bottom foot member;

d. a first aperture located between the said open top end and the bend, said first aperture adapted to accept fixing means for fixing said first end of said first canopy supporting member stabilizing rod thereto;

e. a second aperture located in the compressed top end portion, said second aperture adapted to accept fixing means for fixing the bottom foot portion to the middle vertical portion; and, f. a third and a fourth adjacent apertures located in said horizontal section, wherein said third and said fourth adjacent aperture are adapted to receive anchor means for anchoring the horizontal section to the outdoor surface.

4. The shelter kit as claimed in claim 3 wherein the first middle vertical member and the second middle vertical member are identical, and wherein each of the first and second middle vertical members comprise:

a. a first end having a compressed top portion adapted for mating with and receiving in frictional engagement the adjacent said anticlinal cantilever member;

b. a second end adapted for mating with and receiving in frictional engagement the compressed top portion of the bottom foot portion;

c. a first aperture located in said compressed top portion wherein said first aperture is adapted to accept fixing means for fixing the middle vertical member to the adjacent anticlinal cantilever member; and, d. a second aperture located proximate to said second end, wherein once the bottom foot member and the vertical upright member are mated, said second aperture is adjacent to and coaxial with the bottom foot member second aperture and can accept fixing means to fix the bottom foot member to the middle vertical member.

5. The shelter kit as claimed in claim 4 wherein said first anticlinal cantilever member and said second anticlinal cantilever member are identical and wherein the first and second anticlinal cantilever members each comprise a first vertical section, a second section having a positive acclivity and a third section having a negative acclivity.

6. The shelter kit as claimed in claim 5 wherein said first vertical section comprises:

a. an open bottom end adapted for mating in frictional engagement with the compressed top portion of the adjacent vertical middle member;

b. a first aperture located proximate to said open bottom end wherein said first aperture is adapted to align with the middle vertical member first aperture so that when the open bottom end is mated in frictional engagement with the compressed top portion of the adjacent vertical middle member, said first aperture and the first aperture of the adjacent middle vertical are coaxial and can receive fixing means for fixing the middle vertical member to the anticlinal cantilevered member; and, c. a top end that is integral to said second section.

7. The shelter kit as claimed in claim 6, wherein said second section comprises:

a. a first bend for transitioning the anticlinal cantilever member from the first vertical section through an angle of less than ninety degrees thereby creating said positive acclivity; and, b. a second bend to transition the anticlinal cantilever member from having a positive acclivity to having a negative acclivity.

8. The shelter kit as claimed in claim 7, wherein said third section commences at said second bend, and wherein the third section is imbued with said negative acclivity and further wherein the third section has an open end.

9. The shelter kit as claimed in claim 1, wherein said plurality of bracing rods include a first, second and third lateral bracing rods, wherein each of said first, second and third lateral bracing rods are identical, and wherein each of the first, second and third lateral bracing rods are placed between the first and second anticlinal canopy support members, and wherein each of the said first, second and third lateral bracing rods include:

a. a first end having a concave swaged portion wherein said first end swaged portion is apertured and wherein the first end swaged portion is adapted to conform to the first canopy supporting member; and, b. a second end having a concave swaged portion wherein said second end swaged portion is apertured and wherein the second end swaged portion is adapted to conform to the second canopy supporting member.

10. The shelter kit as claimed in claim 9, wherein:

a. the first lateral bracing rod is positioned between the first bend of the first anticlinal cantilevered member and the first bend of the second anticlinal cantilevered and fixed in position by fixing means;

b. the second lateral bracing rod is positioned between the second bend of the first anticlinal cantilevered member and the second bend of the second anticlinal cantilevered member and fixed in position by fixing means; and, c. the third lateral bracing rod is positioned between the end of the first anticlinal cantilevered member and the end of the second anticlinal cantilevered member and fixed in position by fixing means.

11. The shelter kit as claimed in claim 10 wherein the plurality of bracing rods further comprise:

a. a fourth bracing rod adapted for providing structural support between the first canopy support member and the first lateral bracing rod; and, b. a fifth bracing rod adapted for providing structural support between the second canopy support member and the first lateral bracing rod.

12. The shelter kit as claimed in claim 11, wherein, said fourth and said fifth bracing rods are identical, and wherein:

a. said fourth bracing rod comprises:

i. a first end having a flat swaged portion wherein said flat swaged portion is apertured and wherein the flat swaged portion depends from the longitudinal axis of the bracing rod so that when said first end is placed adjacent to the first anticlinal cantilevered member vertical section the fourth bracing rod has a positive acclivity and extends to the mid portion of the first lateral bracing member;

ii. a second end having a flat swaged portion wherein said flat swaged portion is apertured and wherein the flat swaged portion depends from the longitudinal axis of the bracing rod so that when the said second end is adjacent to the first lateral bracing rod, the flat swaged portion is horizontal;

b. said fifth bracing rod comprises:

i. a first end having a flat swaged portion wherein said flat swaged portion is apertured and wherein the flat swaged portion depends from the longitudinal axis of the bracing rod so that when said first end is placed adjacent to the second anticlinal cantilevered member vertical section the fifth bracing rod has a positive acclivity and extends to the mid portion of the first lateral bracing member;

ii. a second end having a flat swaged portion wherein said flat swaged portion is apertured and wherein the flat swaged portion depends from the longitudinal axis of the bracing rod so that when the said second end is adjacent to the first lateral bracing rod, the flat swaged portion is horizontal;

c. the second flat swaged end of the fourth bracing rod and the second flat swaged end of the fifth bracing rod are adapted to meet at the mid point of the first lateral bracing rod and are further adapted to be fixed thereto by fixing means.

13. The shelter kit as claimed in claim 1 wherein said plurality of bracing rods further includes a first moment resisting rod and a second moment resisting rod, wherein said first moment resisting rod and said second moment resisting rod are identical and wherein:

a. the first moment resisting rod has a longitudinal axis and is adapted for fixed placement between the vertical section of the first cantilevered member and the third section of the first cantilevered member, and wherein the first moment resisting rod includes a first end and a second end, wherein:

i. said first end includes a flat swaged portion and, wherein said flat swaged portion is apertured and, wherein said flat swaged portion depends from the longitudinal axis of the first moment resisting rod so that when said first end of the first moment resisting rod is fixed to the vertical section of the first cantilevered member the flat swaged portion is parallel thereto and the first moment resisting rod has a positive acclivity adapted to extend said second end into contact with the third section of the first cantilevered member;

ii. said second end includes a flat swaged portion and, wherein said flat swaged portion is apertured and, wherein once the first end of the moment resisting member is fixed to the vertical section of the first cantilevered member the second end is parallel and adjacent to the third section of the cantilevered support member;

iii. the first end and the second end of the first moment resisting member are fixed to the first cantilevered member by fixing means;

b. the second moment resisting rod has a longitudinal axis and is adapted for fixed placement between the vertical section of the second cantilevered member and the third section of the second cantilevered member; and wherein the second moment resisting rod includes a first end and a second end, wherein:

i. said first end includes a flat swaged portion and, wherein said flat swaged portion is apertured and, wherein said flat swaged portion depends from the longitudinal axis of the second moment resisting rod, so that when said first end of the second moment resisting rod is fixed to the vertical section of the second cantilevered member the flat swaged portion is parallel thereto, and wherein the second moment resisting rod has a positive acclivity adapted to extend said second end into contact with the third section of the second cantilevered member;

ii. said second end includes a flat swaged portion and, wherein said flat swaged portion is apertured and, wherein once the first end of the second moment resisting member is fixed to the vertical section of the second cantilevered member the second end is parallel and adjacent to the third section of the second cantilevered support member;

iii. the first end and the second end of the second moment resisting member are fixed to the second cantilevered member by fixing means.

14. The shelter kit as claimed in claim 1, wherein fixing means comprise a suitable nut, bolt and locking washer combination manufactured from suitable weather resistant metal.

15. The shelter kit as claimed in claim 1, wherein said canopy comprises:

a. a sheltering rectangular sheet having four sides;

b. a valence depending from each of the said four sides of said rectangular sheltering surface;

c. a plurality of depending flaps fixed to the bottom edges of the sheltering rectangular sheet wherein said flaps are adapted to accept a parade of equally spaced grommets; and, d. a sleeve structure adapted for receiving the third lateral bracing rod in order to fix the sheltering rectangular sheet to the canopy support structure.

16. The shelter kit as claimed in claim 15 wherein said sheltering rectangular sheet is manufactured from a material selected characteristics of flexibility, water impermeability, fire resistance, mould resistance and UV resistance.

17. The shelter kit as claimed in claim 16 wherein the sheltering rectangular sheet is sheet is manufactured from a fabric selected from a group of fabrics comprising the following fabrics: PVC vinyl, sail cloth, parachute cloth, nylon, polyethylene; marine canvass, and marine tonneau.

18. A dismountable outdoor shelter kit for mounting upon an outdoor surface, said shelter kit comprising:

a. an anticlinal canopy having an apex for shedding water and dirt and wherein said canopy is sufficiently dimensioned to provide for an adequate outdoor sheltered area for barbequing operations;

b. an anticlinal canopy support structure comprising:

i. first and second canopy supporting member, wherein said first and second canopy supporting members are identical, and wherein the first and second canopy supporting members comprise:

1. an "L-shaped" bottom foot member adapted to bear the weight of the anticlinal canopy, mated to;
2. a middle vertical member, mated to;
3. an anticlinal cantilevered member adapted to support the anticlinal canopy;
4. a plurality of bracing rods for providing stability to the first and second canopy supporting members; and,
5. fixing means for fixing said plurality of bracing rods to the first and second canopy supporting members.

19. The shelter kit as claimed in claim 18, wherein said canopy comprises:

a. a sheltering rectangular sheet having four sides, wherein said sheltering rectangular sheet is fabricated from a material having characteristics of flexibility, water impermeability, fire resistance, mould resistance and UV resistance;

b. a valence depending from each of the said four sides of said rectangular sheltering surface;

c. a plurality of depending flaps fixed to the bottom edges of the sheltering rectangular sheet wherein said flaps are adapted to accept a parade of equally spaced grommets; and, d. a sleeve structure adapted for receiving at least one of said plurality of said bracing rods in order to fix the sheltering rectangular sheet to the anticlinal canopy support structure.

* * * * *